US009977368B2

(12) United States Patent
Tanaka et al.

(10) Patent No.: US 9,977,368 B2
(45) Date of Patent: May 22, 2018

(54) DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Hiroki Tanaka, Ebina (JP); Motonari Ito, Suntou-gun (JP); Satoshi Sunahara, Hachioji (JP); Akihisa Matsukawa, Fuchu (JP); Toshiki Okamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/652,534

(22) Filed: Jul. 18, 2017

(65) Prior Publication Data

US 2018/0024468 A1 Jan. 25, 2018

(30) Foreign Application Priority Data

Jul. 22, 2016 (JP) ..... 2016-144209
Jun. 21, 2017 (JP) ..... 2017-121453

(51) Int. Cl.
*G03G 15/08* (2006.01)
*G03G 15/09* (2006.01)

(52) U.S. Cl.
CPC ..... *G03G 15/0889* (2013.01); *G03G 15/0921* (2013.01)

(58) Field of Classification Search
USPC ..... 399/119, 120, 252, 254–256, 258, 262, 399/263
See application file for complete search history.

(56) References Cited

U.S. PATENT DOCUMENTS

| | | | | |
|---|---|---|---|---|
| 7,233,758 | B2 | 6/2007 | Osada et al. | |
| 8,331,834 | B2 * | 12/2012 | Koetsuka | G03G 15/0921 399/111 |
| 8,934,819 | B2 * | 1/2015 | Sakamaki | G03G 15/0921 399/277 |
| 9,541,857 | B2 | 1/2017 | Adachi et al. | |
| 2016/0216642 | A1 * | 7/2016 | Kurihara | G03G 15/0921 |
| 2016/0252841 | A1 | 9/2016 | Goto et al. | |
| 2017/0082945 | A1 | 3/2017 | Adachi et al. | |

FOREIGN PATENT DOCUMENTS

| | | |
|---|---|---|
| JP | 2001-092201 A | 4/2001 |
| JP | 2005-173485 A | 6/2006 |

* cited by examiner

*Primary Examiner* — Hoan Tran
(74) *Attorney, Agent, or Firm* — Fitzpatrick, Cella, Harper & Scinto

(57) ABSTRACT

In an axial direction of a developing sleeve that bears magnetic developer on an outer circumferential surface thereof, ends of a sheet-shaped stirring member that stirs the magnetic developer in a container frame to move the magnetic developer toward the developing sleeve are disposed on an outer side of a region in a magnetic field region generated by a magnet roller disposed on an inner side of the developing sleeve. The region has a magnetic field strength equal to or larger than a predetermined magnetic flux density at which the magnetic developer can be borne on the surface of the developing sleeve.

22 Claims, 7 Drawing Sheets

DEVELOPING APPARATUS, PROCESS CARTRIDGE, AND IMAGE FORMING APPARATUS

BACKGROUND OF THE INVENTION

Field of the Invention

The present invention relates to an image forming apparatus which uses an electrophotographic system.

Description of the Related Art

In an electrophotographic image forming apparatus which uses an electrophotographic system such as a laser beam printer or a copying machine, toner is used as powder-like developer. The toner is stored in a developing container, is conveyed to a developing sleeve serving as a developer bearing member by toner conveying means such as a stirring sheet, and is held on the developing sleeve. The toner borne on the developing sleeve is applied with a predetermined charge by a developing blade serving as a developer layer thickness regulating member. The toner moves to an electrostatic latent image formed on a photosensitive drum serving as an image bearing member, whereby the electrostatic latent image is visualized. After that, this visible image is transferred to a recording material such as paper by transfer means and is fixed by a fixing apparatus. Toner remaining on the photosensitive drum without being transferred to the recording material is scraped from the photosensitive drum by a cleaning apparatus being in contact with the photosensitive drum and is delivered to a cleaning container. In this way, a series of image forming processes ends and users can obtain a desired image. Conventionally, a magnetic non-contact developing system is often used as a developing system which uses magnetic mono-component developer.

A magnetic contact developing system is also proposed as another developing system which uses magnetic mono-component developer (see Japanese Patent Application Laid-open No. 2005-173485). This magnetic contact developing system has the characteristics of a magnetic contact developing system (for example, see Japanese Patent Application Laid-open No. 2001-92201) used as a developing system which uses magnetic developer and the above-described magnetic non-contact developing system. In the magnetic contact developing system, an elastic layer is formed on a surface of a developing sleeve to allow the developing sleeve to make contact with a photosensitive drum to perform developing unlike the above-described magnetic non-contact developing system. On the other hand, in the magnetic contact developing system, a magnet serving as a magnetic field generation member is disposed inside the developing sleeve, developer is borne on the surface of the developing sleeve by receiving magnetic force of the magnet similarly to the magnetic non-contact developing system.

SUMMARY OF THE INVENTION

In the conventional developing system which uses magnetic developer, the magnetic developer is maintained on the surface of the developing sleeve by the action of the magnetic force of the magnet included in the developing sleeve. In order to prevent deterioration of the developer on the surface of the developing sleeve occurring due to a developing operation, it is necessary to allow the developer to sufficiently circulate between the developing sleeve surface and a developer storage chamber. As a method for facilitating circulation, a method of allowing a sheet-shaped stirring member to rotate inside a developing chamber and a developer storage chamber is known. However, in order to prevent interference between the stirring member and other members, a design in which a stirring member does not reach the ends of a developer coating region of the developing sleeve is employed. As a result, toner circulation defects may occur at the ends of the developer coating region.

An object of the present invention is to provide a technique for suppressing image defects resulting from developer circulation defects.

In order to attain the object, a developing apparatus of the present invention includes:

a developing sleeve that bears magnetic developer on an outer circumferential surface thereof;

a magnet roller disposed on an inner side of the developing sleeve;

a container frame in which the magnetic developer is stored; and a stirring unit provided in the container frame and including a rotation shaft disposed in a direction along an axial direction of the developing sleeve, and a sheet-shaped stirring member attached to the rotation shaft to move with the rotation of the rotation shaft, the stirring unit stirring the magnetic developer in the container frame by the movement of the stirring member to move the magnetic developer toward the developing sleeve, wherein, in the axial direction of the developing sleeve, ends of the stirring member are disposed on an outer side of a region in a magnetic field region generated by the magnet roller, the region having a magnetic field strength equal to or larger than a predetermined magnetic flux density at which the magnetic developer can be borne on the surface of the developing sleeve.

In order to attain the object, a process cartridge of the present invention includes:

an image bearing member on which an electrostatic latent image is formed; and the developing apparatus, wherein the process cartridge is detachably attached to an image forming apparatus that forms an image.

In order to attain the object, an image forming apparatus of the present invention includes:

an image bearing member on which an electrostatic latent image is formed; and the developing apparatus.

In order to attain the object, an image forming apparatus of the present invention includes:

the process cartridge; and a replenishment cartridge that replenishes the container frame with magnetic developer.

In order to attain the object, a developing apparatus of the present invention includes:

a developing sleeve that bears magnetic developer on an outer circumferential surface thereof;

a magnet roller disposed on an inner side of the developing sleeve;

a container frame in which the magnetic developer is stored; and a stirring unit provided in the container frame and including a rotation shaft disposed in a direction along an axial direction of the developing sleeve, and a sheet-shaped stirring member attached to the rotation shaft to move with the rotation of the rotation shaft, the stirring unit stirring the magnetic developer in the container frame by the movement of the stirring member to move the magnetic developer toward the developing sleeve, wherein ends of the stirring member are disposed on an outer side of ends of the magnet roller in the axial direction of the developing sleeve.

In order to attain the object, a developing apparatus of the present invention includes:

a developing sleeve that bears magnetic developer on an outer circumferential surface thereof;

a magnet roller disposed on an inner side of the developing sleeve;

a container frame in which the magnetic developer is stored; and a stirring unit provided in the container frame and including a rotation shaft disposed in a direction along an axial direction of the developing sleeve, and a sheet-shaped stirring member attached to the rotation shaft to move with the rotation of the rotation shaft, the stirring unit stirring the magnetic developer in the container frame by the movement of the stirring member to move the magnetic developer toward the developing sleeve, wherein a length of the stirring member in the axial direction of the developing sleeve is greater than a length of the magnet roller, and when seen from a direction orthogonal to the axial direction of the developing sleeve, a region corresponding to the magnet roller is present on an inner side of a region corresponding to the stirring member.

According to the present invention, it is possible to suppress image defects resulting from developer circulation defects. The present invention provides more remarkable effects for a developing system in which toner is more likely to deteriorate such as a contact developing system.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 3:
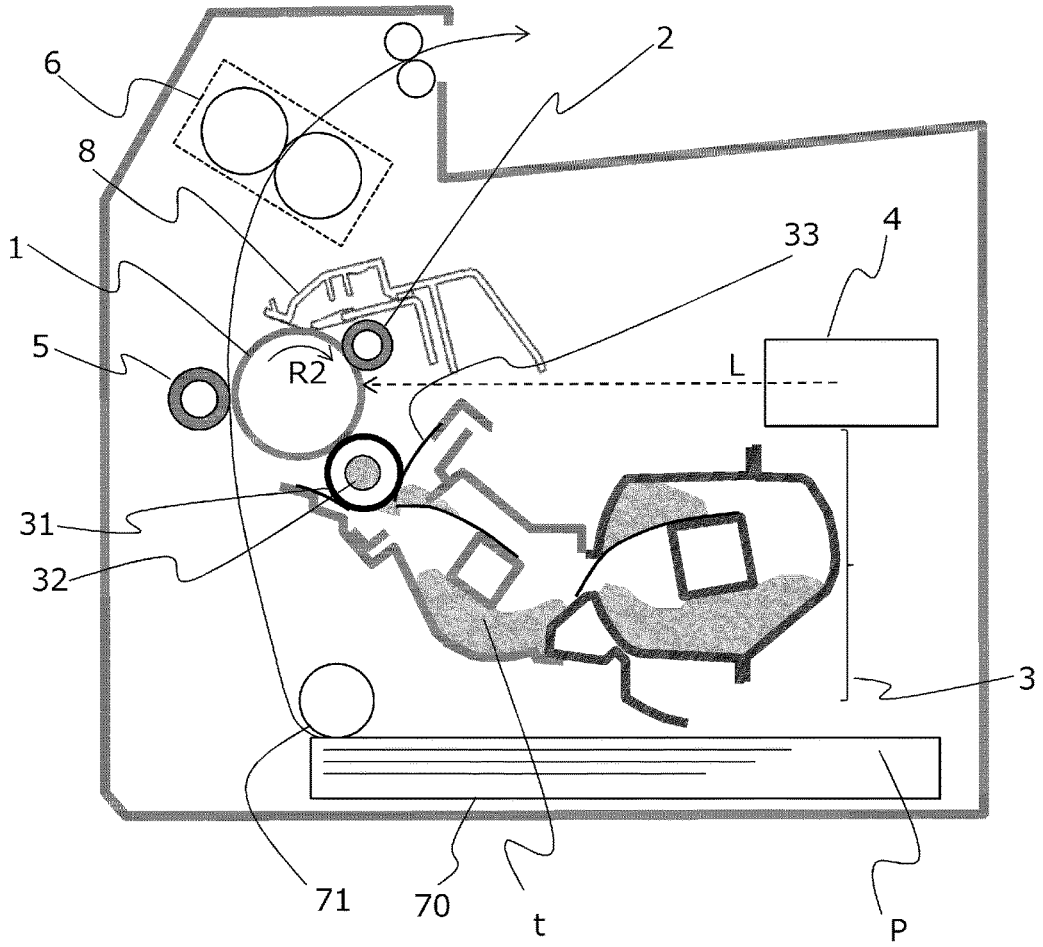
FIG. 3 is a schematic cross-sectional view of an image forming apparatus according to Embodiment 1 of the present invention.

FIG. 3 is a schematic diagram illustrating a configuration of an image forming apparatus (image recording apparatus) according to an embodiment of the present invention. In the present embodiment, a case in which the present invention is applied to a monochrome laser printer which uses a transfer electrophotographic process will be described.

<Image Forming Process>

When a print signal is input to a controller of an image forming apparatus body, the image forming apparatus starts an image forming operation. Each driving unit starts operating at a predetermined timing, and a voltage is applied. A photosensitive drum 1 serving as an image bearing member which is driven to rotate is charged uniformly by a charging roller 2 serving as a charging member. The photosensitive drum 1 charged uniformly is exposed by a laser beam L from a scanner unit 4 which is an exposure unit, and an electrostatic latent image is formed on the surface of the photosensitive drum 1. After that, this electrostatic latent image is visualized as a toner image (developer image) when developer is supplied thereto by a developing sleeve 31 serving as a developer bearing member (this operation is a developing operation). On the other hand, a recording material P which is a recording medium such as paper is separately fed by a supply unit 71 from a storage unit 70, and the recording material P is delivered to a portion (transfer unit) facing the photosensitive drum 1 and a transfer roller 5 which is transfer means in synchronization with the timing at which the toner image is formed on the photosensitive drum 1. The toner image on the photosensitive drum 1 visualized by the developing operation is transferred to the recording material P by the action of the transfer roller 5. The recording material P to which the toner image is transferred is conveyed to a fixing unit 6. Here, the toner image which is not fixed to the recording material P is permanently fixed to the recording material P by heat and pressure. After that, the recording material P is discharged outside the apparatus by a discharge roller and the like. On the other hand, a transfer residual toner remaining on the photosensitive drum 1 after the toner image is transferred is removed by a cleaning apparatus 8 and a subsequent image forming process is performed.

<Description of Developing Apparatus>

Figure 2:
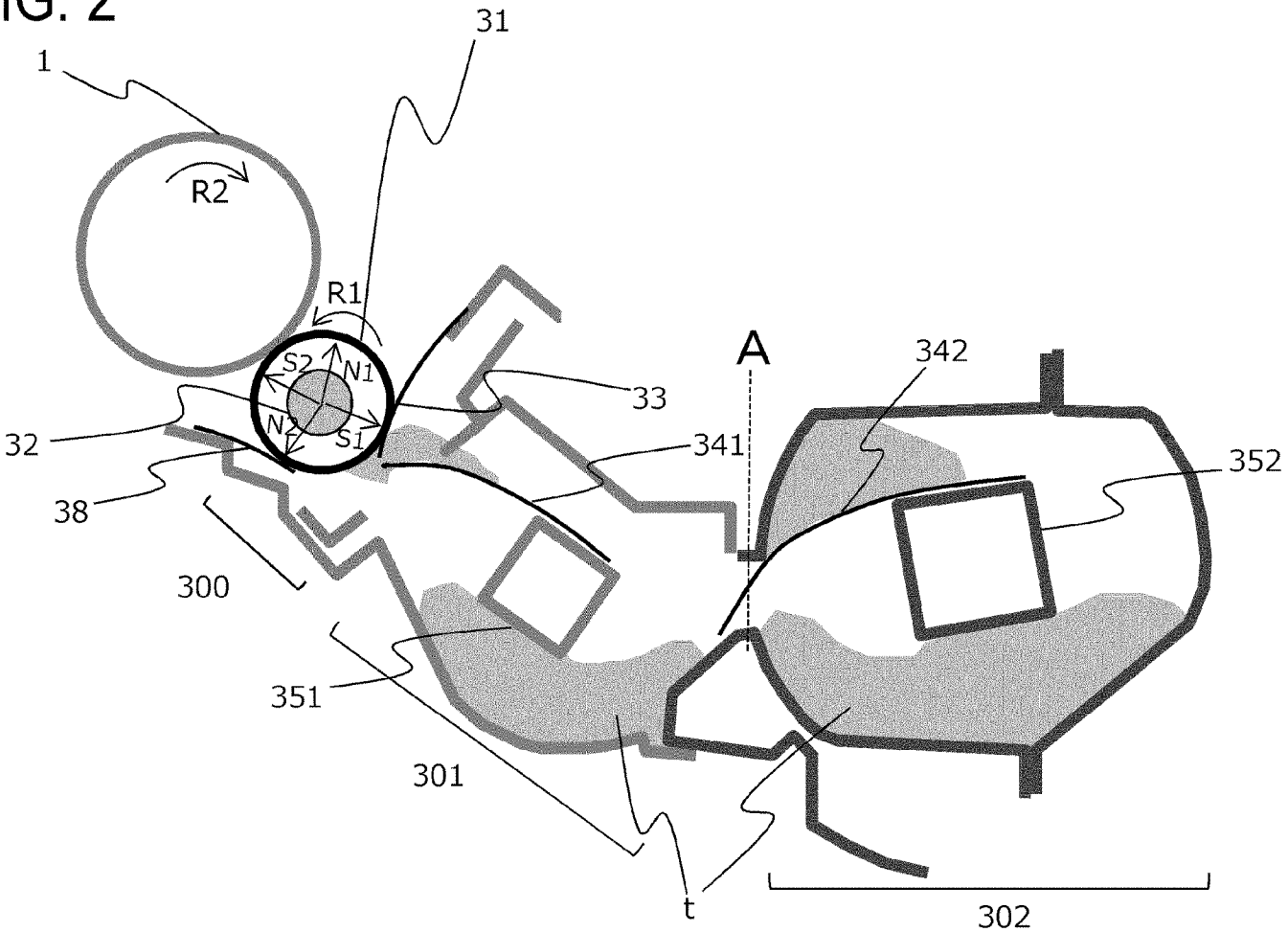
FIG. 2 is a schematic cross-sectional view of the developing apparatus according to Embodiment 1 of the present invention.

In the present embodiment, a magnetic contact developing system and a configuration of a developing apparatus indicated by reference numeral 3 in FIG. 3 are used. A more detailed configuration of the developing apparatus is illustrated in FIG. 2. The developing apparatus includes a frame formed by a developing container 300 that forms a developing chamber and two toner containers 301 and 302 that form a storage chamber (also referred to as a toner chamber) that stores toner. The developing container 300 and the toner container 301 are formed by an integrated frame which is divided into two container spaces by a partition portion that has an opening. The toner container 302 as a replenishment cartridge can be detached and attached from and to the toner container 301 serving as a container frame and is connected to the toner container 301 via an opening A. The developing container 300 has the developing sleeve 31 and a developing blade 33. The toner containers 301 and 302 have stirring sheets 341 and 342 serving as stirring members, respectively.

The developing sleeve 31 is a sleeve-shaped member in which a conductive elastic layer having a thickness of 500 μm is formed on an outer circumference of a nonmagnetic sleeve serving as a supporting portion formed of an aluminum or stainless steel pipe and bears toner on an outer circumferential surface thereof. The developing sleeve 31 is disposed in an opening for allowing toner in the developing container 300 to move outside the container such that a portion thereof is exposed into the developing chamber and is supported on the developing container 300 so as to be rotatable in the direction indicated by arrow R1. The developing blade 33 is provided between the developing sleeve 31 and the opening of the developing container 300 so as to regulate the amount of toner moving from the inside of the container to the outside of the container, and a scooping sheet 38 is provided on the opposite side so as to prevent toner from leaking outside the container. The developing sleeve 31 is formed such that an outer diameter is approximately 11 mm and an average surface roughness (Ra according to JIS standard) is generally between 3.0 μm and 4.0 μm. The developing sleeve 31 is press-fitted toward the photosensitive drum 1 so as to make contact with the photosensitive drum 1.

The developing sleeve 31 is connected to a power supply capable of applying a DC bias as a developing bias, and the latent image on the photosensitive drum 1 is visualized as a toner image when the bias is applied by the power supply. The developing blade 33 which is a toner thickness regulating member that regulates the layer thickness (application amount) of the toner on the developing sleeve 31 applies appropriate charge to the toner by triboelectrification. The developing blade 33 is a urethane rubber blade. In the present embodiment, although the toner is a negative-polarity toner serving as a magnetic mono-component-system developer, another magnetic developer may be used without being limited to a magnetic mono-component developer. A magnet roller 32 serving as a magnetic field generation member is fixedly arranged inside the developing sleeve 31, and the magnet roller 32 has magnetic poles (N1, N2, S1, and S2) in four directions as illustrated in the drawing. The S1 pole is a magnetic pole having the strongest magnetic flux density (magnetic field strength) among the four magnetic poles and allows the toner in the developing container 300 to be attracted and adsorbed to, and held on the developing sleeve 31. The S1 pole is disposed at a position of the developing sleeve 31 overlapping a region that makes contact with the stirring sheet 341, the position being located below a rotation shaft of the developing sleeve 31 in an attitude during use of the image forming apparatus (a normal state in which the image forming apparatus is installed on a horizontal surface). In the present embodiment, although the magnet roller having four poles is used, the number of poles is not limited to four as long as a pole that performs the above-described function is present.

Figure 1:
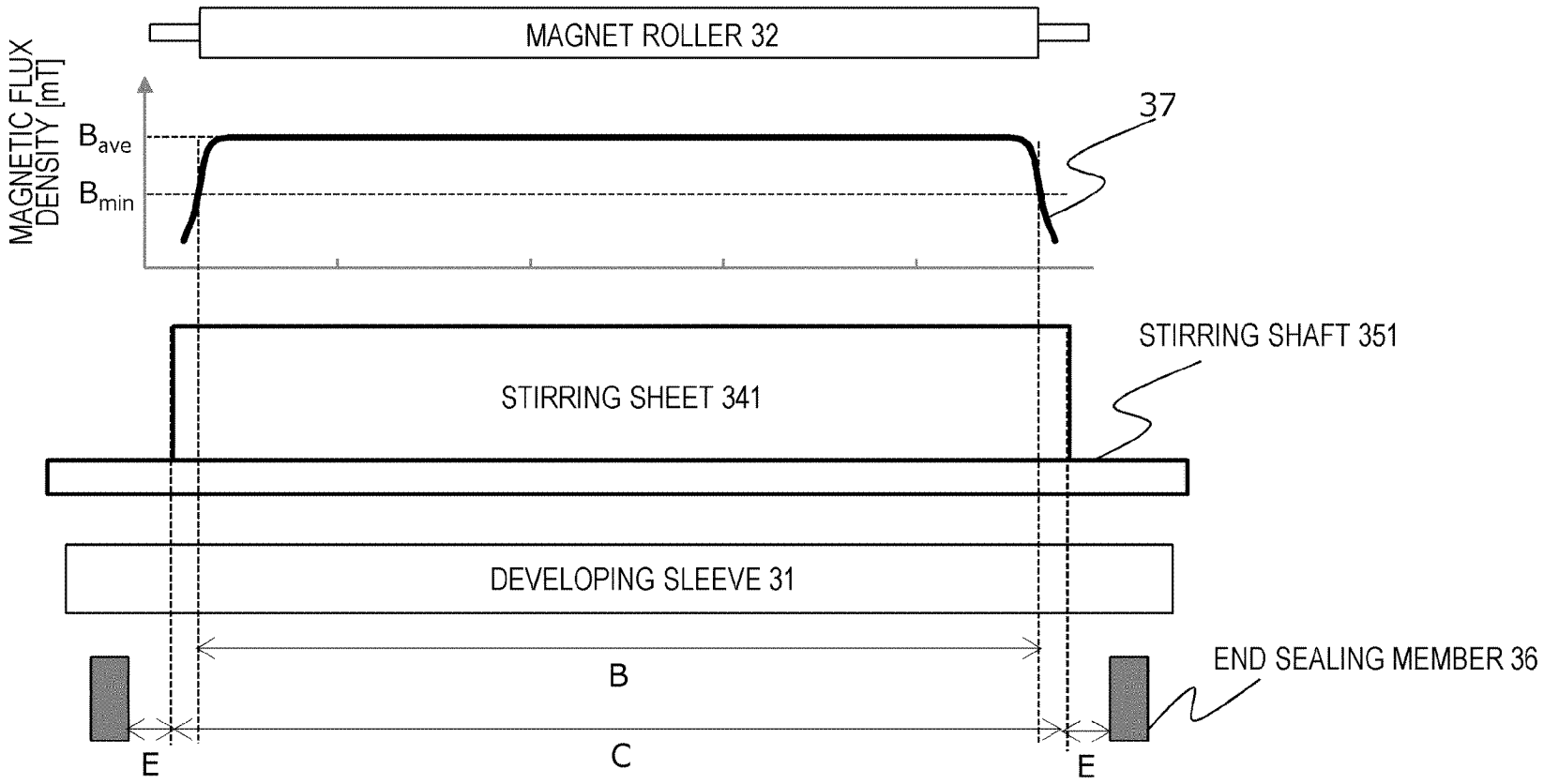
FIG. 1 is a longitudinal schematic diagram of a developing apparatus according to Embodiment 1 of the present invention.

An end sealing member 36 is disposed at both ends of the developing sleeve 31 (see FIG. 1). The end sealing member 36 makes close-contact with the surface of the developing sleeve 31 to secure a sealing property against leakage of the toner t to prevent the toner t from leaking outside the developing container.

The stirring sheets 341 and 342 are sheet-like members having flexibility and are configured such that one set of ends (first ends) are fixed ends respectively fixed to the stirring shafts 351 and 352 serving as rotation shafts, and the other set of ends (second ends) are free ends. When the stirring shafts 351 and 352 rotate as the stirring unit, the stirring sheets 341 and 342 move (rotate) in the chambers in which the respective stirring sheets are disposed, and portions on the distal end side (the second end side) also move inside the chambers that communicate with the chambers in which the stirring sheets are disposed. The stirring sheets 341 and 342 make contact with a bottom portion of the toner container with a predetermined entrance amount (the stirring sheets are designed to have such dimensions that the stirring sheets overlap the bottom portion and make reliable contact with the bottom portion when the stirring sheets are assembled) and dissolve toner in the container. Furthermore, the stirring sheets 341 and 342 convey toner toward the developing sleeve when rotating while rubbing against the bottom portion of the toner container.

The stirring sheet 342 among the two stirring sheets has a role of conveying toner toward the other toner container 301 from the detachable toner container 302. The stirring sheet 341 conveys toner from the toner container 301 to the developing container 300 (that is, from a toner chamber which is a developer storage chamber to a developing chamber). The stirring sheet 341 has a distal end (second end) that can make contact with the outer circumferential surface of the developing sleeve 31. Moreover, the stirring sheet 341 having conveyed the toner brings the toner drawn toward the surface of the developing sleeve 31 by the magnetic force of the magnet roller 32 back to the toner chamber to facilitate circulation of toner inside the toner chamber and the developing chamber. In the present embodiment, the toner chamber is disposed below the developing chamber, and the stirring shaft is positioned below a region of the developing sleeve making contact with the stirring sheet so as to rotate in a direction opposite to a rotation direction of the developing sleeve to scoop up the toner. Moreover, the region of the developing sleeve 31 with which the stirring sheet 341 can make contact is positioned below the position of the rotation shaft of the developing sleeve 31. These positional relations are defined in an attitude during use of the image forming apparatus (a normal state in which the image forming apparatus is installed on a horizontal surface). The apparatus configuration of the developing apparatus is not limited to the above-described configuration. A vertical positional relation of the toner chamber and the developing chamber may be reversed, and the rotation direction of the stirring shaft may be the same as the rotation direction of the developing sleeve.

The stirring sheet 341 employed in the present embodiment is formed of polycarbonate and has a thickness of approximately 130 μm. When a stirring shaft direction is a lane line data, a longitudinal length of the stirring sheet 341 is approximately 220 mm, and a lateral length from a fixed portion of the stirring shaft is approximately 16 mm. The length from the center of rotation of the stirring shaft 351 to the surface of the developing sleeve 31 is approximately 17 mm. The stirring shaft 351 rotates at a speed of approximately 50 rpm and the developing sleeve 31 rotates at a speed of approximately 300 rpm. The stirring sheet 341 is an example used in the present embodiment, and the shape and the relative arrangement of the stirring member are not limited thereto as long as the stirring member has a function of circulating the toner on the surface of the developing sleeve 31. For example, in the present embodiment, although the stirring sheet is a single member, the stirring sheet may be divided into a plurality of parts in the longitudinal direction, and the divided parts may be arranged to be shifted at different phases around the rotation shaft.

By allowing the toner on the surface of the developing sleeve 31 to circulate reliably using the stirring sheet 341, it is possible to provide an appropriate charging amount and an appropriate layer thickness to the toner on the developing sleeve 31 and to maintain a homogeneous image. The toner on the surface of the developing sleeve 31 is held by the magnetic force of the magnetic field of the magnet roller 32. Due to this, the relative arrangement of the stirring sheet 341 and a magnetic field generation region of the magnet roller 32 is important for circulation of the toner on the surface of the developing sleeve 31. The magnetic field generation region of the magnet roller 32 will be described later.

<Definition of Magnetic Field Range of Magnet Roller>

Figure 4:
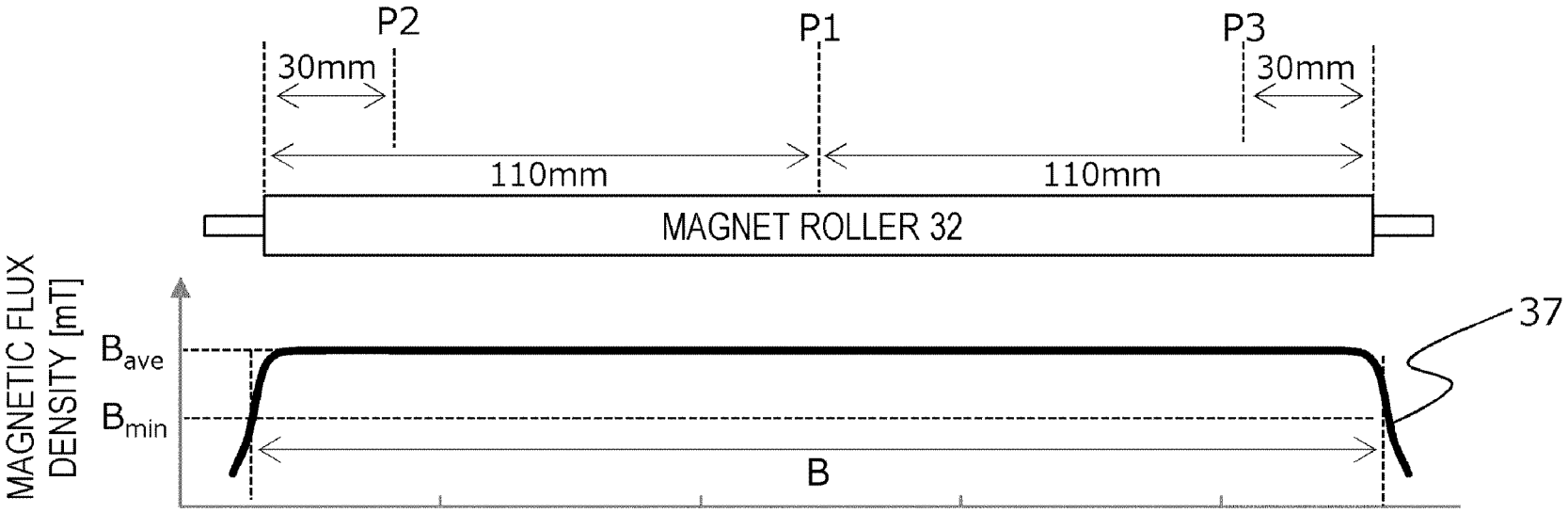
FIG. 4 is a diagram illustrating the relation between a magnet roller and a magnetic flux density distribution of the magnet roller.

FIG. 4 illustrates a magnetic flux density distribution 37 illustrating the strength (magnetic field strength) of a magnetic field of the magnet roller 32 during image formation. The magnetic flux density was measured using a Gauss-Tesla meter (model name: MS-7010 produced by F. W. BELL Corporation). The magnetic flux density at a position corresponding to the surface of the developing sleeve of the S1 pole in FIG. 2 was measured along the longitudinal direction of the developing sleeve.

The Gauss-Tesla meter used for measurement is a magnetic flux density meter which uses Hall elements. A Hall element is a magnetic sensor that outputs a voltage corresponding to a magnetic flux density using the Hall effect in which an electric field (Hall electric field) appears in directions orthogonal to both current and a magnetic field. The direction and the magnitude of electromotive force (Hall electric field) of the Hall element are determined uniquely when the direction and the magnitude of a reference current and a magnetic field generated by a magnet are determined. Due to this, the magnitude and the direction of a magnetic field orthogonal to current and an electric field can be measured on the basis of the direction and the magnitude of an electromotive force (Hall electric field) and the reference current.

An average value of the magnetic flux densities of three magnetic flux density measurement points P1, P2, and P3 in the longitudinal direction (the extension direction of a rotation shaft such as a stirring shaft) in an image forming region which is a region corresponding to a latent image formable region of the photosensitive drum 1 on the surface of the developing sleeve 31 is defined as average magnetic flux density $B_{ave}$. In the present embodiment, the value of $B_{ave}$ is approximately 70 mT. For $B_{ave}$, a magnetic flux density minimally necessary for toner coating is defined as a minimum magnetic flux density $B_{min}$. For magnetic flux densities equal to or smaller than $B_{min}$, it is not possible to supply a sufficient amount of toner to the surface of the developing sleeve 31 and to visualize an appropriate toner image on the photosensitive drum 1. In the present embodiment, a region which is located on the inner side of the end sealing member 39 and in which the magnetic flux density is equal to or larger than the minimum magnetic flux density $B_{min}$ within a magnetic field region on the surface of the developing sleeve 31 formed by the magnet roller 32 is defined as a toner coat region B. In the present embodiment, the value of $B_{min}$ is approximately 49 mT. By circulating the toner coat region B using the stirring sheet 341, it is possible to coat toner having an appropriate charging amount and an appropriate layer thickness on the surface of the developing sleeve 31. In the present embodiment, although a magnetic flux density which is equal to or larger than 70% of the average magnetic flux density is described as a magnetic flux density equal to or larger than a predetermined magnetic flux density required for a magnetic field generated by a magnetic field generation member to develop latent images (required for bearing toner on the developing sleeve 31), the present invention is not limited thereto. The magnetic flux density is set appropriately according to an apparatus configuration and the like.

<Arrangement of Toner Coat Region and Stirring Member in Present Embodiment>

In the magnetic contact developing system used in the present embodiment, since the developing sleeve 31 and the photosensitive drum 1 have an entrance amount, pressure is applied to toner at the nip position and the toner is likely to deteriorate. Particularly, the deteriorated toner may roll on the surface of the developing sleeve 31 and the deterioration is accelerated further unless the magnetic toner drawn to the surface of the developing sleeve 31 by the magnetic force is circulated sufficiently by the stirring member.

Figure 7:
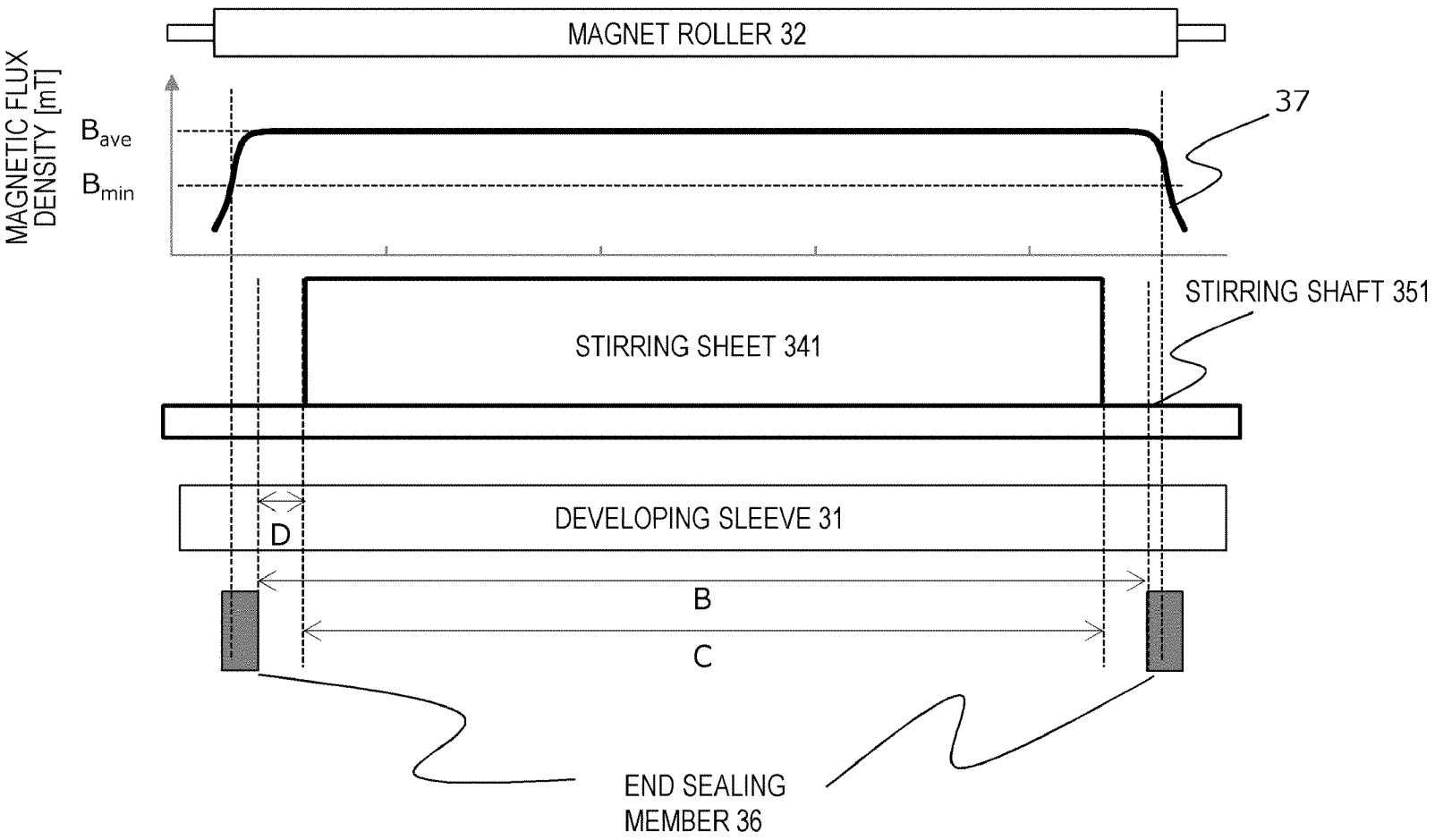
FIG. 7 is a longitudinal schematic diagram of a conventional developing apparatus of a magnetic non-contact developing system.

FIG. 7 illustrates a conventional developing sleeve 31, a magnetic flux density distribution 37 of the magnet roller 32, and a positional relation between the stirring sheet 341 and the end sealing member 36. When the length on the side of the stirring sheet 341 along the stirring shaft is a longitudinal direction, a longitudinal width C of a portion having a largest width in the longitudinal direction of the stirring sheet is a region (stirring region) in which toner is stirred by the stirring sheet 341. Although the longitudinal width C of the stirring sheet 341 has to be as large as possible to circulate the entire toner coated on the surface of the developing sleeve 31, the stirring sheet 341 is disposed on the inner side of the end sealing member 36 in order to avoid interference with the end sealing member 36. In the conventional example, the magnetic flux density of the minimum magnetic flux density $B_{min}$ or larger acts on the entire region of the inner side of the end sealing member by the magnet roller 32. Due to this, the entire inner-side region of the end sealing member 36 is the toner coat region B.

As a result, in the conventional arrangement configuration, a circulation deficient region D is formed between the stirring sheet 341 and the end sealing member 36. In the circulation deficient region D, toner is not circulated by the stirring member although toner is sufficiently drawn toward the surface of the developing sleeve 31 by the magnet roller 32. As a result, a problem such as fogging due to unnecessary transfer of toner to the photosensitive drum (the image bearing member) due to toner deterioration or excessive charging of toner and a problem of an increase in the amount of waste toner occur in the region D.

Figure 6:
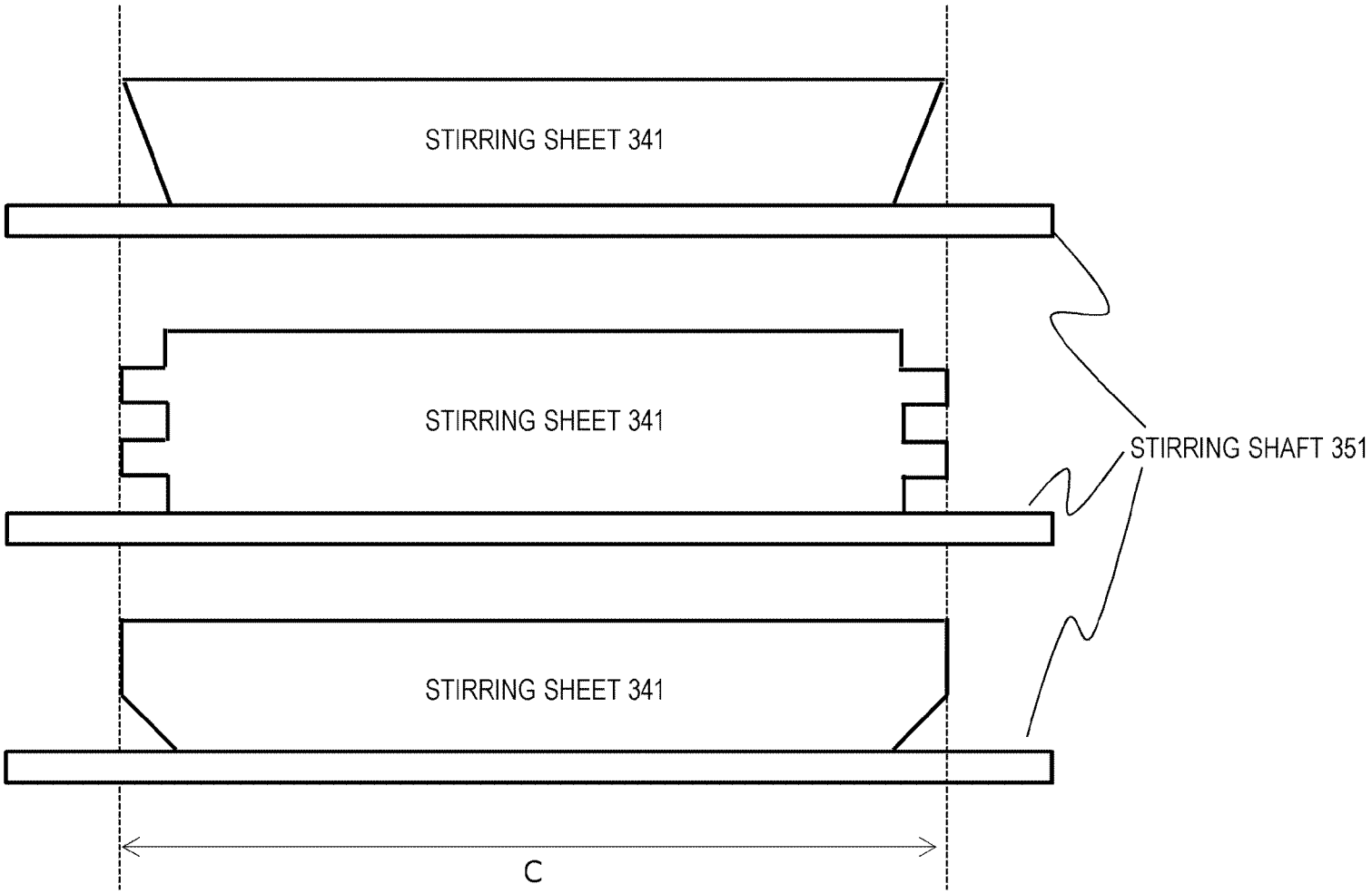
FIG. 6 illustrates an example of other shapes of a stirring sheet.

In contrast, FIG. 1 illustrates a developing sleeve 31 according to the present embodiment, a magnetic flux density distribution 37 of the magnet roller, and a positional relation between the stirring sheet 341 and the end sealing member 36. Although the stirring sheet 341 illustrated in FIG. 1 has a rectangular shape, this is an example and the stirring sheet 341 may have other shapes such as illustrated in FIG. 6. That is, the stirring sheet 341 may have such a shape that the width thereof in the longitudinal direction changes variously in a direction (lateral direction) orthogonal to the longitudinal direction. In this case, a longitudinal width C of a portion having a largest width is a stirring region (that is, the stirring region is formed by a portion of the stirring member having the largest width in the longitudinal direction). In the present embodiment, both end surfaces (both ends) of the stirring sheet 341 are positioned on the outer side of both end surfaces (both ends) of a roller portion (a portion excluding the shaft portion) of the magnet roller 32 in the longitudinal direction (the axial direction of the developing sleeve 31). Due to this, the toner coat region B (the region corresponding to the roller portion of the magnet roller 33) is disposed on the inner side of the stirring region C (the region corresponding to the stirring sheet 341) of the stirring sheet 341. In other words, the ends of the stirring region C are positioned on the outer side of the toner coat region B in the longitudinal direction. With this arrangement, the entire toner in the toner coat region B on the surface of the developing sleeve 31 can be circulated by the stirring region C of the stirring sheet 341. Since magnetic flux density sufficient for drawing toner toward the surface of the developing sleeve 31 does not act in a gap E between the stirring region C and the end sealing member 36, circulation is secured by the mobility of toner.

As a result, it is possible to prevent deterioration of toner on the entire surface of the developing sleeve 31 and excessive charging of toner associated therewith and to suppress image defects resulting therefrom. When a method of magnetizing a portion in the longitudinal direction of the magnet roller 32 so that the region B having the minimum magnetic flux density $B_{min}$ or larger is disposed on the inner side of the stirring region C of the stirring sheet 341 is used, no problem occurs even if the longitudinal width of the magnet roller itself is larger than that of the stirring sheet.

Embodiment 2

Embodiment 2 of the present invention will be described. An image forming apparatus according to Embodiment 2 employs a cleanerless system and is different from that of Embodiment 1 in that the charging roller 2 is driven to rotate and the cleaning apparatus 8 is not provided. In Embodiment 2, description of the same constituent elements as those of Embodiment 1 will not be provided.

<Cleanerless System>

Figure 5:
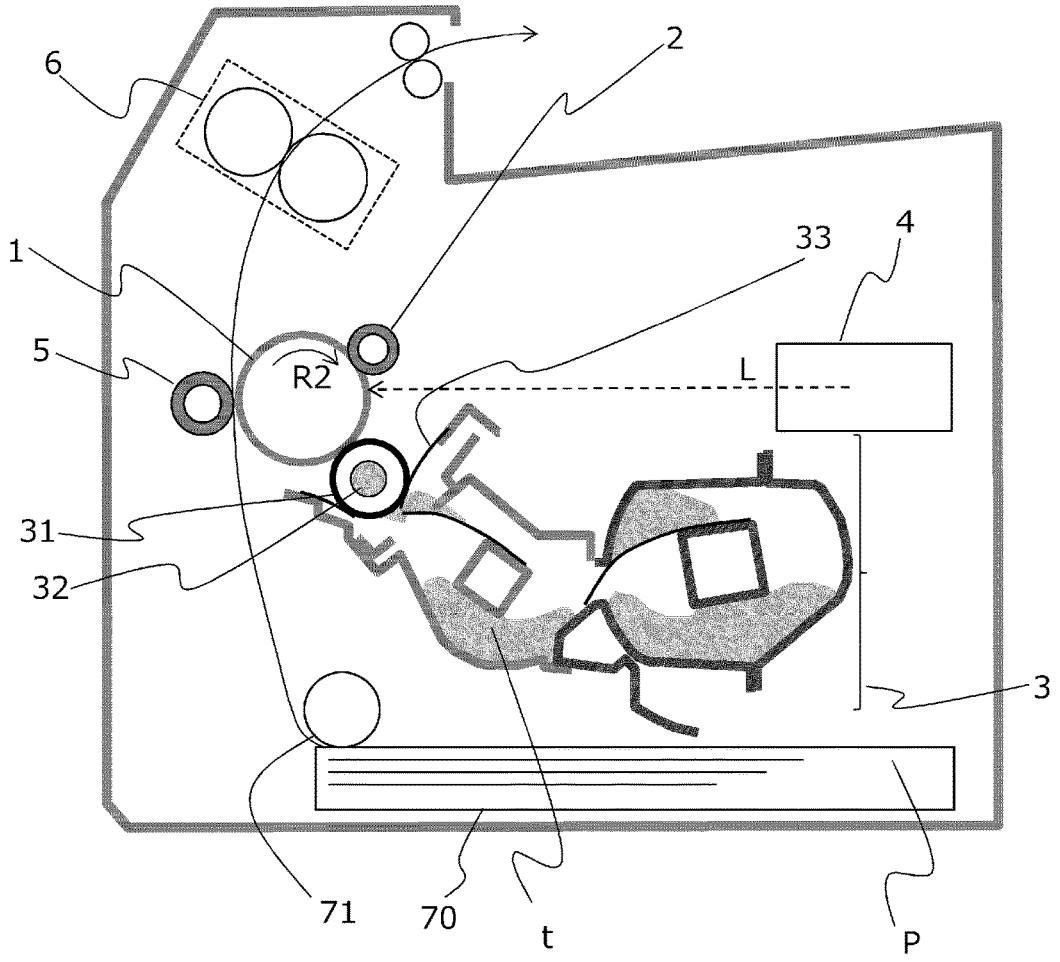
FIG. 5 is a schematic cross-sectional view of an image forming apparatus according to Embodiment 2 of the present invention.

A cleanerless system according to the present embodiment will be described in detail with reference to FIG. 5. Transfer residual toner remaining on the photosensitive drum 1 after a transfer step is performed is charged to a negative polarity similarly to the photosensitive drum 1 by a discharge occurring between the charging roller 2 and the photosensitive drum 1. In this case, the surface of the photosensitive drum 1 is charged to −800 V.

The transfer residual toner charged to a negative polarity does not adhere to the charging roller 2 but passes through a charging portion due to a potential difference relation in the charging portion (the surface potential of the photosensitive drum 1=−800 V and the charging roller potential=−1500 V). The transfer residual toner having passed through the charging portion reaches a laser irradiation position on the surface of the photosensitive drum 1 at which the toner is irradiated with a laser beam from a laser beam scanner 4. Since the amount of transfer residual toner is not so large as to block the laser beam of the laser beam scanner 4, the transfer residual toner has no effect on a step of forming an electrostatic image (latent image) on the photosensitive drum 1. Toner on a non-exposure portion (the surface of the photosensitive drum 1 which is not irradiated with a laser beam) among the toner having passed through the laser irradiation position is collected by the developing sleeve 31 by electrostatic force in a developing portion. Such toner is further collected by the developing apparatus 3 via the developing sleeve 31.

On the other hand, toner on an exposure portion (the surface of the photosensitive drum 1 which is irradiated with a laser beam) among the toner having passed through the laser irradiation position is not collected by electrostatic force but still remains on the photosensitive drum 1 as it is. However, a portion of the toner may be sometimes collected by physical force resulting from a difference in the circumferential velocity between the developing sleeve 31 and the photosensitive drum 1. Such toner is also collected by the developing apparatus 3 via the developing sleeve 31. The toner remaining on the photosensitive drum 1 without being transferred is generally collected by the developing apparatus 3 except for the toner on the exposure portion. The toner collected by the developing apparatus 3 is mixed with the toner stored in the developing apparatus 3 and is used again.

That is, the developing apparatus 3 develops a latent image and collects toner remaining on the photosensitive drum 1 simultaneously. This is one of the biggest characteristics of the cleanerless system.

In the present embodiment, the surface of the developing sleeve has a thickness of approximately 500 μm and has a conductive elastic layer and makes contact with the photosensitive drum with an entrance amount. The developing sleeve rotates in contact with the photosensitive drum at a circumferential speed which is 140% that of the photosensitive drum to thereby collect toner efficiently. In the present embodiment, the charging roller 2 is driven with a circumferential speed difference of 110% in relation to the photosensitive drum 1. A charging roller drive gear is configured to receive driving force by engaging with a gear portion formed in a coupling member provided in the photosensitive drum 1. Since the charging roller 2 is driven with a circumferential speed difference in relation to the photosensitive drum 1, the toner adhering to the charging roller 2 can be charged to a negative polarity by frictional sliding in a contact portion contacting the photosensitive drum 1. In this way, it is possible to return an attached material to the photosensitive drum 1 with the potential difference between the charging roller 2 and the photosensitive drum 1 and to alleviate contamination of the surface of the charging roller 2.

Even in such a cleanerless system of the present embodiment, if the conventional configuration is employed, the circulation deficient region D in which toner is not circulated by the stirring sheet 341 is present at the ends of the developing sleeve 31 as described in Embodiment 1. Therefore, even in the cleanerless system of the present embodiment, a problem such as fogging due to unnecessary transfer of toner to the photosensitive drum due to toner deterioration or excessive charging of toner occurs in the circulation deficient region D in FIG. 7. Moreover, when the circulation deficient region D is present, a problem occurs in terms of a toner collection property which is one of the biggest characteristics of the cleanerless system. Therefore, an appropriate electric field cannot be applied between the photosensitive drum 1 and the developing sleeve 31 due to the toner rolling in the circulation deficient region D and excessive charging of toner. As a result, the toner on the photosensitive drum 1 cannot be appropriately collected to the developing sleeve 31 and toner deterioration and unnecessary transfer of toner to the photosensitive drum 1 are accelerated. Moreover, since the unnecessary toner transferred to the photosensitive drum 1 is not collected by the cleaning apparatus 8, a problem such as contamination of paper ends by toner also occurs.

In the present embodiment, similarly to Embodiment 1, the toner coat region B is disposed on the inner side of the stirring region C of the stirring sheet 341. Due to this, it is possible to suppress deficient circulation of toner at the ends of the developing sleeve 31. Therefore, it is possible to solve a problem such as deficient collection of toner in the cleanerless system as well as the problem such as toner deterioration at the ends of the developing sleeve 31 and unnecessary transfer of toner to the photosensitive drum.

The image forming apparatus according to the respective embodiments has a developing apparatus (an image forming apparatus body) to which the toner container 302 is detachably attached. However, an apparatus configuration to which the present invention can be applied is not limited thereto. For example, the photosensitive drum 1 and the developing apparatus may be integrated as a process cartridge and may be detachably attached to the apparatus body of the image forming apparatus. Here, the apparatus body indicates a constituent element excluding a constituent element that can be detachably attached as a cartridge among the constituent elements of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-144209, filed on Jul. 22, 2016 and No. 2017-121453, filed on Jun. 21, 2017, which are hereby incorporated by reference herein in their entirety.

What is claimed is:

1. A developing apparatus comprising:

a developing sleeve that bears magnetic developer on an outer circumferential surface thereof;

a magnet roller disposed on an inner side of the developing sleeve;

a container frame in which the magnetic developer is stored; and a stirring unit provided in the container frame and including a rotation shaft disposed in a direction along an axial direction of the developing sleeve, and a sheet-shaped stirring member attached to the rotation shaft to move with the rotation of the rotation shaft, the stirring unit stirring the magnetic developer in the container frame by the movement of the stirring member to move the magnetic developer toward the developing sleeve, wherein, in the axial direction of the developing sleeve, ends of the stirring member are disposed on an outer side of a region in a magnetic field region generated by the magnet roller, the region having a magnetic field strength equal to or larger than a predetermined magnetic flux density at which the magnetic developer can be borne on the surface of the developing sleeve.

2. The developing apparatus according to claim 1, wherein the predetermined magnetic flux density is a magnetic flux density which is 70% of an average magnetic flux density of a magnetic field in a portion corresponding to a region, on an image bearing member, in which an electrostatic latent image can be formed during image formation.

3. The developing apparatus according to claim 1, wherein the magnetic developer is magnetic mono-component developer.

4. The developing apparatus according to claim 1, wherein the developing sleeve develops an electrostatic latent image on an image bearing member in a state of being in contact with the image bearing member during image formation.

5. The developing apparatus according to claim 1, wherein the stirring member has a first end serving as a fixed end fixed to the rotation shaft, and a second end serving as a free end.

6. The developing apparatus according to claim 5, wherein the second end of the stirring member can make contact with the outer circumferential surface of the developing sleeve.

7. The developing apparatus according to claim 6, wherein a region of the developing sleeve that can make contact with the stirring member in an attitude during use is positioned below the position of the rotation shaft of the developing sleeve.

8. The developing apparatus according to claim 1, wherein the stirring member is a single member.

9. The developing apparatus according to claim 1, wherein the container frame includes:

a developing chamber in which the developing sleeve is disposed;

a storage chamber in which the stirring member is disposed and toner is stored; and a partition portion having an opening through which the developing chamber and the storage chamber communicate with each other.

10. The developing apparatus according to claim 9, wherein the storage chamber is disposed below the developing chamber in an attitude during use.

11. The developing apparatus according to claim 1, wherein a rotation direction of the stirring unit is opposite to a rotation direction of the developing sleeve.

12. The developing apparatus according to claim 1, wherein the rotation shaft is disposed below the developing sleeve in an attitude during use.

13. The developing apparatus according to claim 1, wherein the stirring member has such a shape that a width thereof in an axial direction of the rotation shaft changes in a direction orthogonal to the axial direction of the rotation shaft, and at least ends of the stirring member at a portion having a largest width in the axial direction of the rotation shaft is positioned on an outer side of a region having the magnetic field strength equal to or larger than the predetermined magnetic flux density.

14. The developing apparatus according to claim 1, wherein the magnetic developer remaining on an image bearing member after a developer image formed on the image bearing member by a developing operation is transferred is collected from the image bearing member by the developing sleeve.

15. The developing apparatus according to claim 1, end surfaces of the stirring member are disposed on an outer side of end surfaces of the magnet roller in the axial direction of the developing sleeve.

16. The developing apparatus according to claim 1, wherein a developing bias applied to the developing sleeve is a DC bias.

17. The developing apparatus according to claim 1, the developing apparatus is detachably attached to an image forming apparatus that forms an image.

18. A process cartridge comprising:

an image bearing member on which an electrostatic latent image is formed; and the developing apparatus according to claim 1, wherein the process cartridge is detachably attached to an image forming apparatus that forms an image.

19. An image forming apparatus comprising:

the process cartridge according to claim 18; and a replenishment cartridge that replenishes the container frame with magnetic developer.

20. An image forming apparatus comprising:

an image bearing member on which an electrostatic latent image is formed; and the developing apparatus according to claim 1.

21. A developing apparatus comprising:

a developing sleeve that bears magnetic developer on an outer circumferential surface thereof;

a magnet roller disposed on an inner side of the developing sleeve;

a container frame in which the magnetic developer is stored; and a stirring unit provided in the container frame and including a rotation shaft disposed in a direction along an axial direction of the developing sleeve, and a sheet-shaped stirring member attached to the rotation shaft to move with the rotation of the rotation shaft, the stirring unit stirring the magnetic developer in the container frame by the movement of the stirring member to move the magnetic developer toward the developing sleeve, wherein ends of the stirring member are disposed on an outer side of ends of the magnet roller in the axial direction of the developing sleeve.

22. A developing apparatus comprising:

a developing sleeve that bears magnetic developer on an outer circumferential surface thereof;

a magnet roller disposed on an inner side of the developing sleeve;

a container frame in which the magnetic developer is stored; and a stirring unit provided in the container frame and including a rotation shaft disposed in a direction along an axial direction of the developing sleeve, and a sheet-shaped stirring member attached to the rotation shaft to move with the rotation of the rotation shaft, the stirring unit stirring the magnetic developer in the container frame by the movement of the stirring member to move the magnetic developer toward the developing sleeve, wherein a length of the stirring member in the axial direction of the developing sleeve is greater than a length of the magnet roller, and when seen from a direction orthogonal to the axial direction of the developing sleeve, a region corresponding to the magnet roller is present on an inner side of a region corresponding to the stirring member.

* * * * *